US006164909A

United States Patent [19]

Ehlers et al.

[11] Patent Number: 6,164,909

[45] Date of Patent: Dec. 26, 2000

[54] RADIAL FAN

[75] Inventors: Michael Ehlers, Nagold; Bernhard Stephan, Filderstadt, both of Germany

[73] Assignee: Modine Manufacturing Company, Racine, Wis.

[21] Appl. No.: 09/194,993

[22] PCT Filed: Mar. 27, 1998

[86] PCT No.: PCT/EP98/01819

§ 371 Date: Dec. 3, 1998

§ 102(e) Date: Dec. 3, 1998

[87] PCT Pub. No.: WO98/45600

PCT Pub. Date: Oct. 15, 1998

[30] Foreign Application Priority Data

Apr. 3, 1997 [DE] Germany ..... 197 13 712

[51] Int. Cl.[7] ..... F04D 29/44

[52] U.S. Cl. ..... 415/208.1; 415/170.1; 415/173.1; 415/173.3; 415/173.6; 415/211.1; 416/189; 416/192; 416/193 R; 165/41; 165/140

[58] Field of Search ..... 415/170.1, 173.1, 415/173.3, 173.5, 173.6, 174.2, 174.5, 208.1, 211.1; 416/189, 192, 193 R; 141/49; 123/41.51; 165/41, 124, 125, 126, 140, DIG. 311, DIG. 313, DIG. 314

[56] References Cited

U.S. PATENT DOCUMENTS

| | | | |
|---|---|---|---|
| 3,642,062 | 2/1972 | Edmaier et al. | 165/125 |
| 4,398,508 | 8/1983 | Moon et al. | 123/41.49 |
| 4,432,694 | 2/1984 | Kuroda et al. | 415/170 |

FOREIGN PATENT DOCUMENTS

| | | |
|---|---|---|
| 364410 | 8/1979 | Austria . |
| 1528797 | 5/1968 | France . |
| 1426866 | 12/1968 | Germany . |
| 1605269 | 8/1970 | Germany . |
| 1905269 | 8/1970 | Germany . |
| 4431840 | 3/1995 | Germany . |
| 4431839 | 8/1996 | Germany . |

*Primary Examiner*—F. Daniel Lopez
*Assistant Examiner*—James M. McAleenan
*Attorney, Agent, or Firm*—Wood, Phillips, VanSanten, Clark & Mortimer

[57] ABSTRACT

The invention concerns a radial fan (1), especially as a fan for the cooling unit (2) of a vehicle. The fan includes an impeller (3) with radial blades (4), a cover disc (5) designed nozzle-like, and an air guide ring (6), as well as a stationary inflow nozzle (8). An axial air gap (10) is provided between the cover disc (5) and the co-rotating air guide ring (6).

19 Claims, 2 Drawing Sheets

RADIAL FAN

FIELD OF THE INVENTION

The invention concerns a radial fan, especially as a fan for the cooling unit of a vehicle, comprising an impeller with radial blades, a cover disc formed like a nozzle, an air guide ring fastened to it, an impeller bottom, as well as a stationary inlet nozzle.

SUMMARY OF THE INVENTION

Radial fans provided with these features are known from DE 44 31 839 A1 and DE 44 31 840 A1. In radial impellers made of plastic, moldability of the curved cover disc inlet from the injection molding die is difficult or impossible. The curvature of the covered disc inlet on the also-curved inlet nozzle, however, is essential to reduce the gap losses that arise from separation of the airflow. It is therefore proposed in these two documents to produce separate air guide rings, which are fastened adjacent to the cover disc. These air guide rings, however, are necessary solely for manufacturing reasons, as explained above. In order to reduce power losses occurring from the air gap between the stationary inlet nozzle and the rotating impeller, blade continuations are provided, in one case, on the cover disc of the impeller, and individual auxiliary blades on the cover disc input are arranged in the other case. These parts can lead to an improvement of efficiency. If options that are favorable from the standpoint of energy economy are chosen to drive the radial fan (directly from the engine of the vehicle), problems occur, consisting of the fact that the engine and thus the impeller and the other rotating parts attached to it execute movements in the axial and radial direction relative to the stationary inlet nozzle, which can be greater than 10 mm. The air gap must therefore be chosen large enough, so that these tolerances can be compensated and contact between the parts is reliably prevented. This again adversely affects the efficiency of the fan, because the power losses caused by the unduly large gap are enormous. The aforementioned auxiliary blades and blade continuations cannot offer an adequate remedy here, because with greater spacing or gap the spacing between the auxiliary blades also becomes greater, which significantly reduces their effect. Elastic covers are a remedy here, which can reduce the losses from the larger air gap, but these losses nevertheless remain enormously large.

PRESENTATION OF THE INVENTION

The task of the invention is to propose a radial fan, especially as a fan for the cooling unit of a vehicle, which permits significantly larger tolerances between the rotating impeller and stationary inlet nozzle, without causing a significant deterioration in the efficiency of the fan.

The solution according to the invention proposes that the air gap that produces gap flow be designed between the cover disc and a corotating air guide ring. The air gap should be dimensioned uniformly over its entire periphery. The air guide ring of a first embodiment has a lower partially circular section facing the cover disc when viewed in cross section, and a roughly vertical section positioned between the cover disc and the stationary inlet nozzle. The air guide ring of a second embodiment additionally has a roughly horizontal section facing the inlet nozzle, and connected on top to the vertical section.

The horizontal section of the air guide ring and the entire air guide ring have significant spacing from the stationary inlet nozzle, so that the tolerance compensation between the rotating and fixed parts of the radial fan is possible without a significant deterioration in efficiency of the fan. This gap or spacing of the air guide ring from the inlet nozzle is provided with appropriate covers The different embodiments of the cover are guided according to which embodiment of the air guide ring is chosen. In the embodiment of the air guide ring without the upper horizontal section, elastic elements, for example, brushes, rubber elements or the like, are arranged either on the inflow nozzle or on the vertical section of the air guide ring. The other embodiment has a circular part arranged around the inflow nozzle.

It was demonstrated in numerous experiments that the efficiency can withstand comparison with other radial fans that do not possess the possibilities of greater tolerance compensation.

It is significant that the most favorable drive (from an energy economy standpoint) from the crankshaft of the engine can be chosen, which has a positive effect on the overall energy balance of the vehicle or installation.

The minimal air gap causing gap flow between the cover disc and the entrained air guide ring always remains constant, despite possible movements between the fixed and rotating parts, and can therefore continuously exert its positive effects, which consist of the fact that separation of the surface flow on the cover disc is prevented. It is also favorable, if this gap between the cover disc and air guide ring tapers toward the impeller, because this leads to a nozzle effect, which improves the effect just described. At the narrowest site, on the end of the gap, the gap width can preferably be between 2 and 5 mm.

The connection between the cover disc and the co-rotating air guide ring can be a releasable connection, for example, a screw connection, or also an unreleasable connection, for example, a welded joint or glue joint. Corresponding connection parts are distributed on the periphery.

The good efficiency of the radial fan is further supported by the fact that the collar-like end of the inlet nozzle, which guides the air from the intake side to the pressure side, is designed in cross section in the form of a quarter circle, or somewhat smaller than a quarter circle. The tangent of the quarter circle again comes in contact with the partial circular lower section of the air guide ring. The tangent of the partial circular section of the air guide ring also comes in contact with the partial circular section of the cover disc. It is precisely this last-named design that also serves for optimal gap flow, i.e., produces a situation in which the air flow is not separated from the cover disc and produces harmful turbulence.

Additional features follow from the patent claims. Features and effects also follow from the subsequent description of a practical example, which refers to the accompanying drawings. The important details for the present invention are given the reference numbers (1) to (21) below.

BRIEF DESCRIPTION OF THE INVENTION

Figure 3:
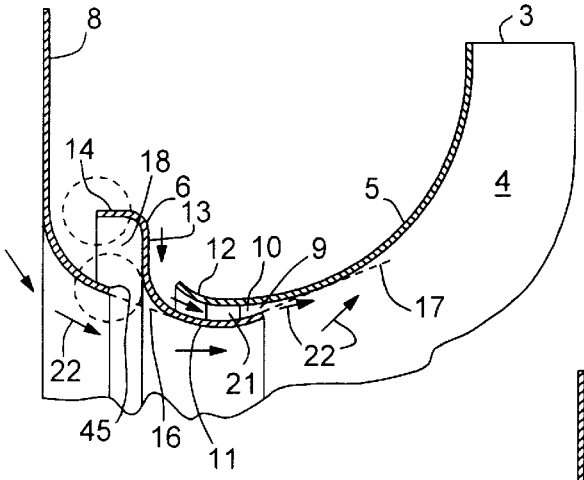
FIG. 3 shows detail "X" from FIG. 1 in a first variant.
Figure 4:
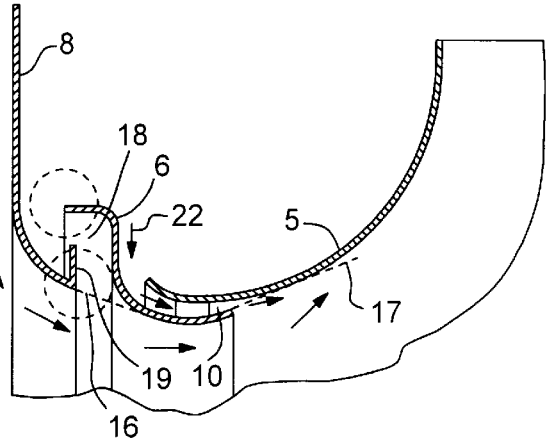

FIG. 4, like FIG. 3—with a gap cover.

Figure 1:
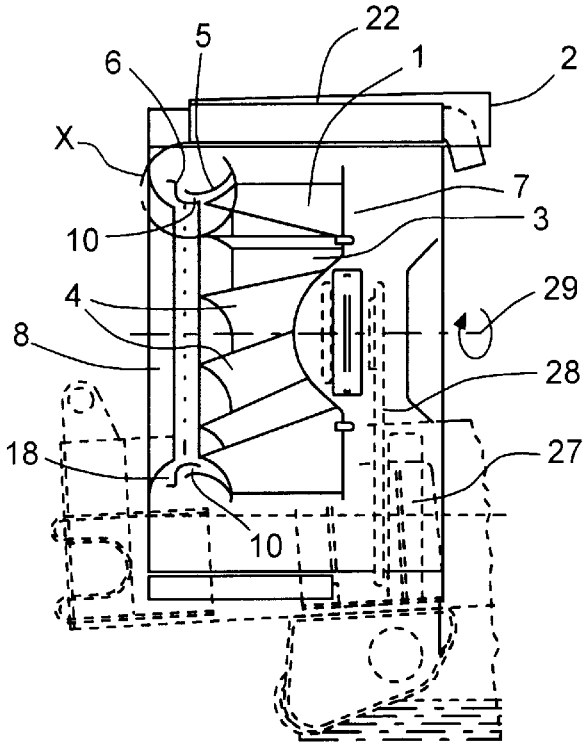
FIG. 1 shows a side view of a radial fan in the cooling unit of a vehicle.
Figure 5:
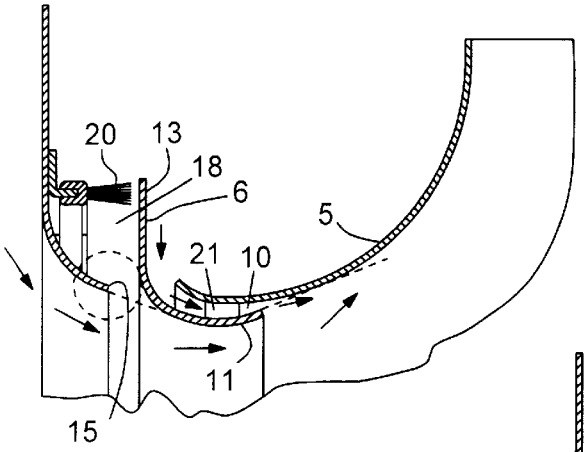

FIG. 5 shows detail "X" from FIG. 1 in a second variant with a gap cover.

Figure 6:
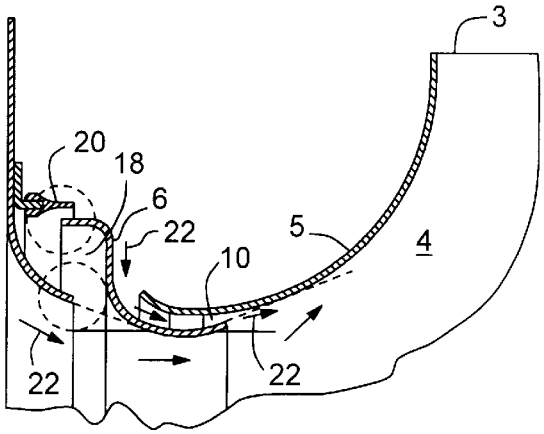

FIG. 6, similar to FIG. 4—with another gap cover.

DETAILED DESCRIPTION OF THE PREFERRED EMBODIMENTS

Figure 2:
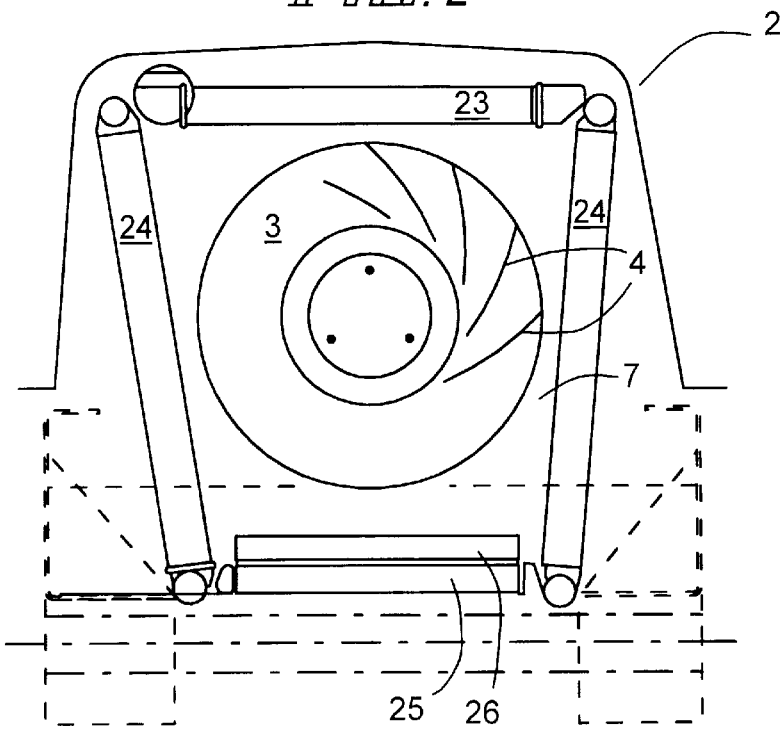
FIG. 2 shows a cooling unit with a radial fan viewed from behind.

FIGS. 1 and 2 are shown schematically and depict a box-like cooling unit (2), in which the radial fan (1) is situated, whose impeller (3) rotates around axis (29). The air is drawn in axially and diverted radially to the cooler (23, 24, 25, 26) of cooling unit (2). The box-like cooling unit (2) consists here of an upper charge air cooler (23), coolant coolers (24) arranged on the right and left, an oil cooler (25) and condenser (26) arranged on the bottom, which are arranged behind each other in the direction of air flow. Such cooling units are common in larger vehicles.

As seen in FIG. 2, the coolers (23, 24, 25) are arranged in a nominally polygonal shape around the impeller (3), with each ofthe coolers (23, 24, 25) having a length dimension extending perpendicular to the axis (29) and defining a side of the polygonal shape. The length dimensions of the coolers (23, 24, 25) are not all the same. For example, the length dimension of the cooler (23) is shorter than the length dimension of both the coolers (25) and (26).

The radial fan (1) is driven from engine (27) of the vehicle. Transfer of the torque to radial fan (1) occurs via a V-belt drive (28). In other applications the radial fan (1) can be connected directly via a coupling to the crankshaft of engine (27). Direct drive from engine (27) to radial fan (1) is the most favorable option from the standpoint of energy economy. However, this embodiment requires a larger spacing gap (18) between the stationary and rotating parts, because vibrations are produced by temperature fluctuations and by running of the engine lead to changes in position that must be equalized. In so doing, contact between parts logically must not occur, nor must the power of the radial fan (1) suffer significantly because of this, since, otherwise, it would not be ensured that the projected cooling power would also be achieved in the phases of greatest cooling demand. All of this is allowed for in the following embodiment.

Here the region marked "X" in FIG. 1 is of greater significance and is depicted in FIGS. 3 to 6 as a sectional view in two embodiments. The imaginary impeller axis (29) runs horizontally beneath the individual FIGS. 3 to 6. The gap is denoted with reference number (18), which now permits much greater tolerance compensation between the stationary inflow nozzle (8) and the impeller (3) with the co-rotating guide ring (6), than is the case with the prior art. This is apparent in FIGS. 3 to 6 from the circles with dashed lines. In FIGS. 3 to 6 the same parts have the same reference numbers, which were fully given in FIG. 3, only for better clarity.

The air guide ring (6) in FIGS. 3, 4 and 6 consists of the lower partial circular section (11), the vertical section (13) and the upper horizontal section (14).

In FIGS. 4 to 6 only the parts essential there are given reference numbers. It follows from the figures that connection parts (21) are arranged between cover disc (5) and air guide ring (6). Several such connection parts (21) are uniformly distributed on the periphery. In the sectional view only one connection part (21) is depicted. It is understood that the undepicted cross section of the connection part (21) has a shape favorable to flow. The tapering air gap (10) between the air guide ring (6) and the cover disc (5) is apparent. The width of the air gap should be 3 mm on the end (9) of air gap (10) facing impeller (3). A good suction effect for the partial air stream flowing from impeller (3) on the top is achieved by this. The partial air stream, which is actually viewed as a power loss and occurs in all radial fans, is returned to the main stream via air gap (10). Return occurs, so that the partial air stream is guided along the inside surface of cover disc (5). Turbulence of the air stream is largely avoided on this account. To support this effect, the tangent (16) of the partial circular collar (15) of inflow nozzle (8) is aligned with the partial circular section (11) of the air guide ring (6). The tangent (17) of the partial circular section (11) is roughly aligned with the partial circle (12) of cover disc (5). The suction effect just described draws off most of the partial air stream, so that the relatively large gap (18) that permits the desired tolerance compensation has no significant harmful effect with respect to power loss. To further reduce these harmful effects, different possibilities for gap covers have been entered in FIGS. 4 to 6. In FIG. 4 the circular part (19) is provided as gap cover, which is arranged around the collar (15) of inflow nozzle (8). The circular part (19) can be a flexible plastic. In contrast to this, FIG. 6 shows an elastic gap cover (20). This is a rubber ring 20. The ring 20 has a somewhat larger diameter than the diameter formed by the upper horizontal section (14) of guide ring (6). The ring 20 is fastened on the inflow nozzle (8) and extends in an axial direction to above the end of horizontal section (14).

FIG. 5 shows advantageous embodiments, in which the air guide ring (6) consists only of the vertical section (13) and the lower partial circular section (11). This air guide ring (6) has lower manufacturing costs with comparably good effects. To cover the gap (18), an elastic cover (20), consisting of brush-like parts, is provided here, which is arranged in annular fashion. This cover (20) is also attached to the inflow nozzle (8) and extends in an axial direction to right against the vertical section (13) of air guide ring (6).

LIST OF EMPLOYED REFERENCE NUMBERS

1 Radial fan
2 Cooling unit
3 Impeller
4 Radial blades
5 Cover disc
6 Air guide ring (AGR)
7 Impeller bottom
8 Inflow nozzle
9 End of air gap
10 Air gap between guide ring and cover disc
11 Partial circle on guide ring
12 Partial circle on cover disc
13 Vertical section on AGR
14 Horizontal section on AGR
15 Collar-like end on inflow nozzle
16 Tangent between quarter circle and partial circular section AGR
17 Tangent of section AGR to partial circle of cover disc
18 Gap between AGR and inflow nozzle
19 Circular part
20 Elastic gap covering
21 Connection part AGR-cover disc
22 Flow arrows
23 Charge air cooler
24 Coolant cooler
25 Oil cooler
26 Condenser
27 Engine
28 V-belt
29 Axis of impeller

What is claimed is:

1. An impeller comprising:

a hub moveable about a hub axis;

a plurality of blades having spaced first and second ends, the first ends of the blades attached to the hub;

an annular nozzle-like plate attached to the second ends of the blades; and an annular guide attached to the plate and spaced so as to define a radial passage therebetween.

2. The impeller according to claim 1, further comprising:

a wall having a first end connected to the annular guide and a second end spaced radially outward from the first end and having a rim extending axially therefrom.

3. The impeller according to claim 1, wherein the radial distance between the guide and the plate decreases axially in the direction of the hub.

4. The impeller according to claim 3, wherein the radial distance between the guide and the plate at a location closest axially to the hub is uniform.

5. The impeller according to claim 4, wherein the radial distance between the guide and the plate at the location closest axially to the hub is between approximately 3–5 mm.

6. A fan comprising:

a nozzle-like inlet piece with an opening therethrough;

a hub moveable about an axis relative to said nozzle-like inlet piece;

a plurality of blades having spaced first and second ends, the first ends of the blades attached to the hub;

an annular nozzle-like plate attached to the second ends of the blades, the plate spaced from the inlet piece to define a gap therebetween; and an annular guide attached to the plate in the gap and spaced from the plate to define a passage therebetween.

7. The fan according to claim 6, further comprising means for sealing the gap to limit air flow except through the passage.

8. The fan according to claims 7, wherein the means for sealing the gap comprises a first wall having a first end attached to the annular guide and a second end spaced radially from the first end and having a rim extending axially therefrom.

9. The fan according to claim 7, wherein the means for sealing the gap comprises:

a first wall having a first end attached to the annular guide and a second end spaced radially from the first end and having a rim extending axially therefrom; and a second wall having a first end attached to the inlet piece and a second end spaced radially from the first end, the second wall spaced from the first wall to define a chamber therebetween, the rim extending between the first and second walls.

10. The fan according to claim 7, wherein the means for sealing the gap comprises:

a first wall having a first end attached to the annular guide and a second end spaced radially from the first end; and an elastically deformable brush-like element having a first end attached to the inlet piece and a second end spaced axially from the first end and abutting the first wall.

11. The fan according to claim 7, wherein the means for sealing the gap comprises:

a first wall having a first end attached to the annular guide and a second end spaced radially from the first end and having a rim extending axially therefrom; and an elastically deformable second wall having a first end attached to the inlet piece and a second end spaced axially from the first end and abutting the rim of the first wall.

12. The fan according to claim 6, wherein:

the nozzle-like inlet piece has an arcuate cross-section, the nozzle-like plate has an arcuate cross-section, the annular guide has an arcuate cross-section, a line extending tangent from the nozzle-like inlet piece is tangent to the annular guide, and a line extending tangent from the annular guide is tangent to the nozzle-like plate.

13. A combination fan and cooling unit device for a vehicle including an engine, the device comprising:

a radial impeller rotatable about an axis, the radial impeller having an outer circumference;

a plurality of heat exchangers arranged around the outer circumference of the radial impeller in a nominally polygonal shape to receive radially outwardly directed air flow from the radial impeller, each of the heat exchangers having a length dimension extending perpendicular to said axis and defining a side of said nominally polygonal shape, at least two of said length dimensions being unequal to each other, at least one of the plurality of heat exchangers being a coolant cooler, and at least another of the plurality heat exchangers being a condenser.

14. The combination fan and cooling unit device of claim 13 further comprising:

a nozzle-like inlet piece with an opening therethrough, said nozzle-like inlet piece fixed relative to said heat exchangers; and wherein said radial impeller comprises:

a hub moveable about a hub axis;

a plurality of blades having spaced first and second ends, the first ends of the blades attached to the hub;

an annular nozzle-like plate attached to the second ends of the blades, the plate spaced from the inlet piece to define a gap therebetween; and an annular guide attached to the plate in the gap and spaced from the plate to define a passage therebetween.

15. The combination fan and cooling unit device of claim 14 wherein said radial impeller is connected directly via a coupling to a crankshaft of the engine.

16. The combination fan and cooling unit device of claim 13 wherein said plurality of heat exchangers comprises four heat exchangers and said nominally polygonal shape is a nominally trapezoidal shape, with said length dimension of each of the four heat exchangers defining one side of said nominally trapezoidal shape.

17. The combination fan and cooling unit device of claim 13 wherein at least one of the heat exchangers is a charge air cooler.

18. The combination fan and cooling unit device of claim 13 wherein at least one of said heat exchangers is an oil cooler.

19. The combination fan and cooling unit device of claim 13 wherein at least two of said heat exchangers are coolant coolers.

* * * * *